United States Patent [19]

Akira

[11] Patent Number: 4,628,659

[45] Date of Patent: Dec. 16, 1986

[54] IRON REINFORCING ROD STRUCTURE FOR REINFORCING THE BASE OF BUILDINGS

[76] Inventor: Hayashi Akira, 2-7 5 Bancho Minami Sako, Tokushima Ken, Japan

[21] Appl. No.: 757,117

[22] Filed: Jul. 19, 1985

[51] Int. Cl.[4] ..... E04H 12/18

[52] U.S. Cl. ..... 52/646; 52/648; 52/664

[58] Field of Search ..... 52/645, 646, 633, 637, 52/648, 651, 652, 664, 686, 719

[56] References Cited

U.S. PATENT DOCUMENTS 3,705,473 12/1972 Yeffal-Rueda ..... 52/648 X 3,863,416 2/1975 Oroschakoff ..... 52/719 X 4,003,178 1/1977 Douthwaite ..... 52/648 X 4,122,228 10/1978 Tolliver et al. ..... 52/719 X

*Primary Examiner*—Carl D. Friedman

*Assistant Examiner*—Naoko N. Slack

*Attorney, Agent, or Firm*—Donald D. Mon; David O'Reilly

[57] ABSTRACT

The specification discloses a preassembled iron reinforcing rod structure for reinforcing a concrete base of a building comprising lateral rods welded to horizontal side rods and interconnected with vertically oriented rotatable rods which may be folded over parallel to the side rods for transportation.

5 Claims, 6 Drawing Figures

IRON REINFORCING ROD STRUCTURE FOR REINFORCING THE BASE OF BUILDINGS

FIELD OF THE INVENTION

This invention relates to an iron reinforcing rod structure for reinforcing the base of buildings such as the concrete base of a wooden house.

BACKGROUND OF THE INVENTION

Heretofore, an iron reinforcing rod structure was manually assembled in a groove cut in the ground by a worker, but it required much effort in cutting rods, assembling rods, and fastening the rods with wires and metal bands.

BRIEF DESCRIPTION OF THE INVENTION

It is an object of this invention to eliminate these drawbacks by providing a rod reinforcing structure which may be preassembled in a factory easing assembly in place.

Another object of this invention is to provide an L-shaped rod for easily connecting right angle structures. The above and other features will be more fully understood from the following detailed description and the accompanying drawings in which:

FIGS. *2a, b, c, d* and *e* are end views illustrating different configurations of lateral rods for different embodiments of the invention.

DETAILED DESCRIPTION OF THE INVENTION

Figure 1:
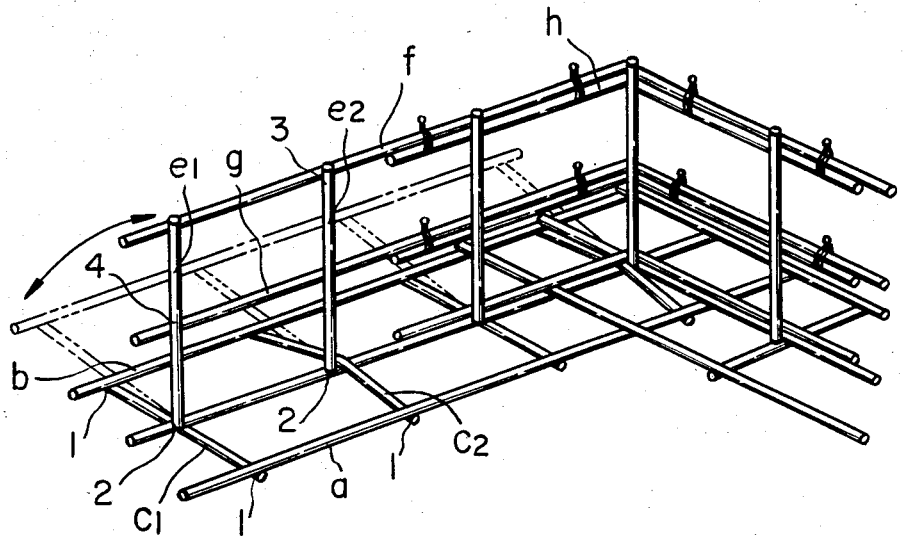
FIG. 1 is a perspective view of one embodiment of the invention.
Figure 2A:
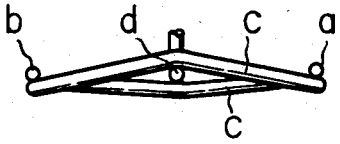
Figure 2B:
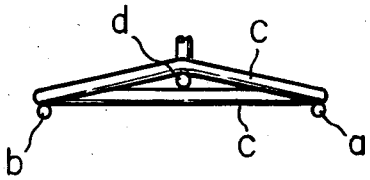
Figure 2C:
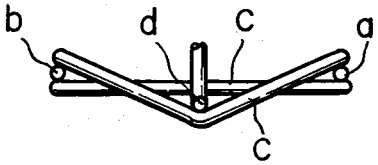
Figure 2D:
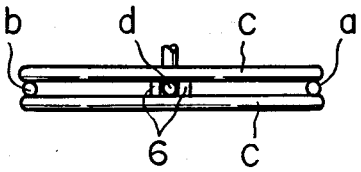
Figure 2E:
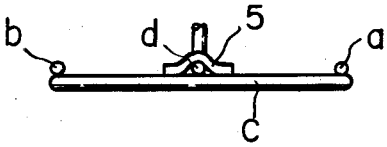

As seen in FIG. 1, a plurality of lateral rods $C_1$ $C_2$ . . . $C_n$ are spot welded at opposite ends as at 1, 1 to parallel side rods a, b, at predetermined, equally spaced distances from each other. Rod d is supported approximately at the center of lateral rods $C_1$, $C_2$, . . . $C_n$ parallel to said side rods a and b. Lower ends 2, 2, . . . of vertical rods $e_1$, $e_1$, $e_2$, . . . e2, . . . en are spot welded to said rod d at a predetermined equally spaced distances from each other. Lengthwise rod f is spot welded to upper ends 3, 3 . . . of vertical rods $e_1$, $e_2$ . . . $e_n$. A secondary lengthwise rod g is welded along the center 4, 4, . . . of vertical rods $e_1$, $e_2$, . . . $e_n$. L-shaped connection rod h is provided for making right angle connections to the structure.

Usually, rods e, f and g are in a folded horizontal position (shown in phantom) or plane, as indicated by the arrow, and overlap rods a, b, c. Therefore the structure is substantially flat and easy to transport to a place of use.

In use, the assembled structure is placed in the bottom of a groove cut in the ground and vertical rods $e_1$, $e_2$, . . . $e_n$ with lengthwise rods f, g attached, rotated to a vertical plane as shown in FIG. 1 to a position extending upward from rod d. Neighboring structures in the same direction or in a right angle direction are connected by L-shaped connecting rods h along a length of rods f, g or d.

Concrete is then cast around the assembly to form the base or foundation for a building.

FIGS. *2a, b, c, d, e,* are end views of the lower part of the structure illustrating different configurations of the lateral rods for various embodiments of this invention.

FIG. *2a* is an end view corresponding to the embodiment shown in FIG. 1.

In FIG. *2a* a structure is shown in which lateral rods C, C . . . etc., are alternating bent rods and straight rods one after another.

In FIG. *2b* the straight lateral rods C, C . . . etc., lie on top of and are spot welded to the upper side of parallel rods a, b.

In FIGS. *2a* and *2b,* rod d is positioned at the bent portion of lateral rods C, C . . . etc.

In FIG. *2c*, alternating bent and straight lateral rods C, C . . . etc., are alternately welded to the lower or under side and upper side of parallel rods a, b one after another.

In FIG. *2d,* lateral rods C, C . . . etc. have bearing or positioning members 6 for fixing their position on rod d welded on lateral rods C, C instead of using bent rods.

In FIG. *2e,* semicircular supports or bearings rods 5 are fixed welded to lateral rods C, C, . . . etc. to provide support and position them on rod d.

We claim:

1. A preassembled iron reinforcing rod structure for reinforcing a concrete base of a building comprising: a plurality of equally spaced apart lateral rods spot welded at opposite ends to a plurality of equally spaced parallel horizontal side rods; a plurality of vertically oriented equally spaced rotatable rods centrally supported between said parallel horizontal side rods by a horizontal support rod; and at least one lengthwise connecting rod spot welded to said vertical rods; and vertical rods being rotatable to a folded position substantially parallel to said side rods for transportation of said reinforcing rod structure to a construction site whereby the horizontal support rod is welded to the lateral rod after rotation into place.

2. An iron reinforcing rod structure for reinforcing the base of a building as claimed in claim 1 including L-shaped connecting rods fastened to at least one lengthwise rod for connecting said reinforcing rod structure to an adjacent right angle reinforcing rod structure.

3. An iron reinforcing structure according to claim 1 in which said lateral support rods are bent to have said opposite ends spot welded on one side of said parallel horizontal support rods and the center of said lateral support rod pass around the opposite side of said lengthwise support rod.

4. An iron reinforcing rod structure according to claim 3 in which only alternate lateral support rods are bent.

5. An iron reinforcing rod structure according to claim 3 in which said bent lateral support rods alternately have the center pass over or under said lengthwise support rod.

* * * * *